US006270384B2

(12) United States Patent
Jaag

(10) Patent No.: US 6,270,384 B2
(45) **Date of Patent: *Aug. 7, 2001**

(54) CONNECTING TERMINAL ASSEMBLY

(75) Inventor: Dieter Jaag, Villingen-Schwenningen (DE)

(73) Assignee: Ria Electronics Albert Metz (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/151,010

(22) Filed: Sep. 10, 1998

(30) Foreign Application Priority Data

May 27, 1998 (DE) ..... 198 23 648

(51) Int. Cl.[7] ..... H01R 4/48
(52) U.S. Cl. ..... 439/835; 439/729
(58) Field of Search ..... 439/725, 729, 439/834, 835, 441

(56) References Cited

U.S. PATENT DOCUMENTS 5,679,021 * 10/1997 Krämer ..... 439/835
5,685,735 * 11/1997 Hohorst ..... 439/441
5,853,304 * 12/1998 Landreau et al. ..... 439/835

FOREIGN PATENT DOCUMENTS

0052767 * 10/1981 (DE) .
0 052 767 10/1981 (DE) .
3418536 A1 5/1984 (DE) .
42 39 480 11/1992 (DE) .
195 04 092 A1 2/1995 (DE) .
196 11 762 A1 3/1996 (DE) .
0 632529 A2 6/1993 (EP) .

* cited by examiner

*Primary Examiner*—Hien Vu
(74) *Attorney, Agent, or Firm*—Eugene E. Renz, Jr.

(57) ABSTRACT

A connecting terminal assembly for printed circuit boards comprising, an insulating housing 10, a connection contact 18 having an insertion opening 24 attached to the housing 10 through which a conductor can be inserted under the connection contact 18, a clamping means 26 having an elastic sidepiece 52, cooperatively associated with an actuating element 40 having a pressure surface 48 supported in the housing 10 operable between a clamping position, wherein the clamping means 34 pulls the conductor which has been inserted through the insertion opening 24 against the connection contact 18, and an open position allowing the insertion of the conductor, means mounting the actuating element 40 in such a way that it can slide back and forth to perch the actuating element 40 to an open position where it presses the elastic sidepiece 32 down so that the elastic force of the elastic sidepiece 32 locks into a latching recess 56 and when the actuating element 40 is lifted out of the latching recess 56 against the force of the elastic sidepiece 32, the actuating element 40 is pushed back by the elastic sidepiece 32 into the clamping position.

1 Claim, 1 Drawing Sheet

CONNECTING TERMINAL ASSEMBLY

BACKGROUND OF THE INVENTION

A connecting terminal of the general type to which the present invention relates is known from, for example, DE 4,239,480 A1 and DE 196-11,762 A1. In this known connecting terminal, the actuating element is designed as a lever mounted in a housing with freedom to pivot. In one of the positions into which it is pivoted, this lever presses the free elastic sidepiece of the clamping spring down into its open position, whereas, in a second pivoted position, the lever releases the sidepiece of the spring, so that it can clamp a conductor which has been inserted. A curved cam surface on the pivoting lever causes the elastic sidepiece of the clamping spring to move the required distance between the open position and the clamping position. So that a stroke of the required distance can be achieved by means of the pivoting movement of the lever, it is necessary for the lever to move over a relatively large pivot angle. If the lever, as is standard practice, is pivoted by means of a suitable tool such as a screwdriver, it is necessary for this tool to have sufficient room to pivot. In many situations where the connecting terminal is installed, however, this type of actuation can be difficult.

SUMMARY OF THE INVENTION

The invention is based the task of designing a connecting terminal of the general type indicated above in such a way that it can be actuated easily and can be constructed simply.

This task is accomplished in accordance with the invention by means of a connecting terminal characterized by novel features of construction and arrangement which is easy to operate and of compact design. The basic idea of the invention consists in pushing the actuating element like a wedge between the elastic sidepiece of the clamping spring and an inside wall of the housing. When the actuating element is pushed inward against the elastic force of the sidepiece, it presses the sidepiece into its open position. As a result of the wedge shape of the actuating element, the sidepiece of the spring can push it back and arrive in its clamping position after the actuating element is released. In the open position, the actuating element locks in a latching receptacle in the inside wall of the housing and is held in the locked position by the elastic force of the sidepiece.

It is extremely easy to actuate the connecting terminal. To bring the connecting terminal into the open position, the wedge-shaped actuating element is merely pushed inward by a suitable tool such as a screwdriver. Because only a linear displacement of the actuating element is required for this purpose, a small free space is sufficient for the intervention of the tool. The actuating element locks itself automatically in the open position and holds itself there. To bring the connecting terminal into the clamping position, the actuating element must merely be lifted out of the latching receptacle against the force of the sidepiece of the spring. Because of the wedge shape of the actuating element, the elastic force of the sidepiece is then able to push it into the clamping position. To move the actuating element out of its locked position, the tool requires only a small pivot angle, which means again that only a small amount of room needs to be made available for the intervention of the tool.

If the connecting terminal is mounted on a printed circuit board, the direction in which the conductor to be clamped is introduced can be essentially parallel to the plane of the printed circuit board. In this arrangement, the route along which the actuating element is pushed can also be nearly parallel to the plane of the printed circuit board. The force acting on the connecting terminal during actuation thus has only a minimum component acting in the direction perpendicular to the printed circuit board, which means that the board is subjected to only minimal stress during the actuation of the connecting terminal.

The actuating element is a molded part of extremely simple design. Because no pivot bearing is required for the actuating element, the design of the housing is also very simple. Assembly is also easy, because the actuating element can simply be inserted loosely into the housing. As a result, the connecting terminal is also especially suitable for automated assembly.

BRIEF DESCRIPTION OF THE DRAWINGS

These and other objects of the present invention and various features and details of the operation and construction thereof are hereinafter more fully set forth with reference to the accompanying drawings, wherein.

The invention is explained in greater detail on the basis of an exemplary embodiment, which is illustrated in the drawing.

DETAILED DESCRIPTION OF THE PREFERRED EMBODIMENT

Figure 1:
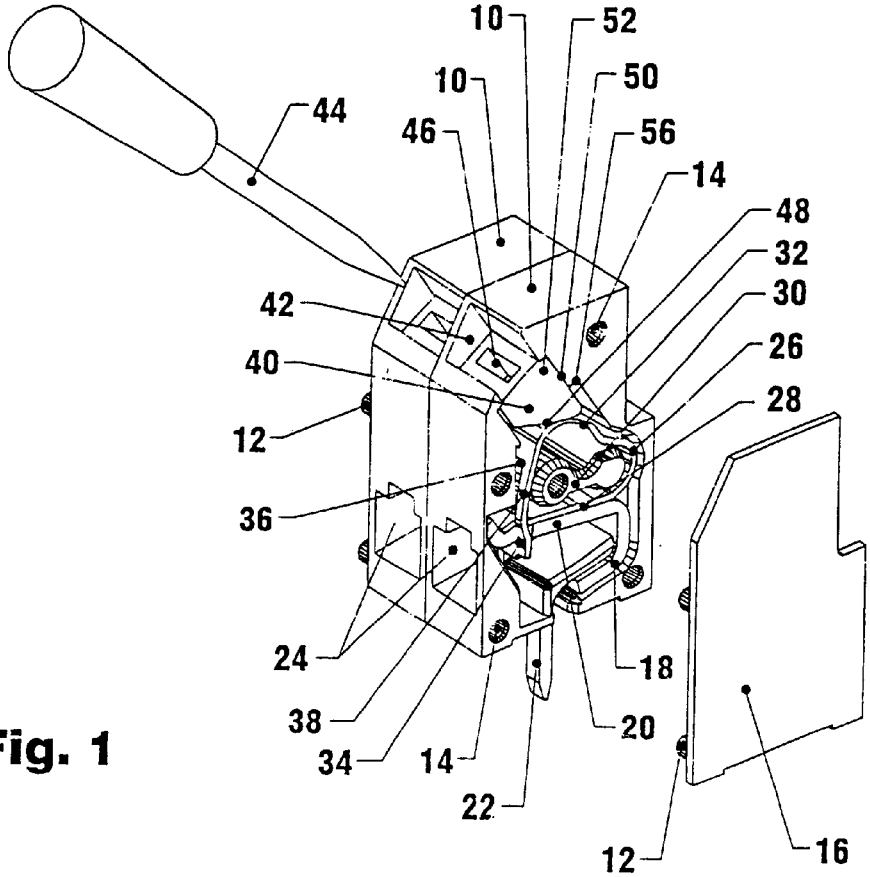
FIG. 1 shows a perspective view of the connecting terminal in the clamping position, with the side cover removed.

As can be seen from the drawing, the connecting terminal consists of a single-pole clamping module. Individual clamping modules can be joined together in any desired number to form a multi-pole connecting terminal.

Each single-pole connecting terminal has a housing 10 of plastic. Pins 12 are molded onto one side of housing 10; corresponding holes 14 are provided on the opposite side. When housing 10 is assembled to form a multi-pole connecting terminal, pins 12 of one housing module engage in the corresponding holes 14 of the adjacent housing module.

Each housing 10 has a frame, which is sealed off on one side by a side wall, so that a holding space is formed inside housing 10. During the assembly of a multi-pole connecting terminal, the open side of housing 10 is closed off by the corresponding closed side of adjacent housing 10. The open side of housing 10 which comes at the end of the row of a multi-pole connecting terminal is closed off by a side cover 16, which corresponds to the closed side wall of housing 10 and which is provided with corresponding pins 12.

In the holding space of housing 10, a connection contact 18 is inserted from the open side; this contact is a dimensionally stable sheet-metal part. Connection contact 18 is bent into the shape of a "U" one of the sidepieces of the U forms a contact bridge 20, whereas the other sidepiece continues as a soldering pin 22. Soldering pin 22 passes out through the bottom of housing 10. The bottom of housing 10 is set down on a printed circuit board so that soldering pin 22 can engage in a hole in the printed circuit board, to which it is then soldered. U-shaped connection contact 18 opens toward the front end of the frame of housing 10. An insertion opening 24, which is aligned with U-shaped connection contact 18, passes through this front end of the frame.

Above contact bridge 20 of connection contact 18 there is a clamping spring 26, one sidepiece 28 of which rests on the rear surface of contact bridge 20 at the top. Proceeding from this sidepiece 28, clamping spring 26 is bent upward and around a positioning projection 30. Positioning projection 30 is molded onto the side of housing 10 and projects into the holding space of housing 10. Above positioning projection 30, clamping spring 26 forms a free elastic sidepiece 32, which is itself bent down toward sidepiece 28, with the result that free sidepiece 32, the end of which forms a clamping end 34, is essentially perpendicular to both sidepiece 28 and contact bridge 20. An opening 36 is provided in clamping end 34. Contact bridge 20 of connection contact 18 and sidepiece 28 of clamping spring 26, which rests on the bridge, pass through this opening. Clamping spring 26 is made of an elastic, springy metal, which is pretensioned in such a way that sidepiece 32 is always trying to pivot away from sidepiece 28 and contact bridge 20. As a result, the conductor is clamped against contact bridge 20 and is connected in an electrically conductive manner to soldering pin 22 via connection contact 18.

An actuating element 40, which is produced as a separate plastic part, is used to actuate the connecting terminal. When the connecting terminal is assembled, this element is placed in the holding space of housing 10.

Actuating element 40 has the form of a wedge and is supported in the holding space of housing 10 between sidepiece 32 of clamping spring 26 and the upper inside wall of housing 10. Actuating element 40 is accessible through an opening 42 in the frame of the housing, which is located in the front end of the connecting terminal above insertion opening 24 for the conductor. A tool such as a screwdriver 44 can be inserted through this opening 42; a recess 46 in actuating element 40 ensures that screwdriver 44 can engage positively with the actuator.

Actuating element 40 tapers down from its wider end, where the tool engages with it, toward the inside in the form of a wedge and has a pressure surface 48, by which it rests against elastic sidepiece 32. Wedge surface 50, opposite pressure surface 48, forms a locking edge 52 on the wider end of actuating element 40. Wedge surface 50 of actuating element 40 rests against a slanted inside wall 54 of housing 10. This inside wall 54, which serves as a sliding surface for actuating element 40, has in its middle area a step-shaped latching recess 56.

In the clamping position shown in FIG. 1, the wide end of actuating element 40 rests from the inside against opening 42 of housing 10. In this position, actuating element 40 is located outside the range over which spring sidepiece 32 can travel. Elastic sidepiece 32 is free to deflect elastically outward far enough so that clamping edge 38 comes to rest under the force of the spring against contact bridge 20. If a conductor has been inserted into opening 36 in clamping end 34 of elastic sidepiece 32, this conductor is then clamped elastically between clamping edge 38 and contact bridge 20.

Figure 2:
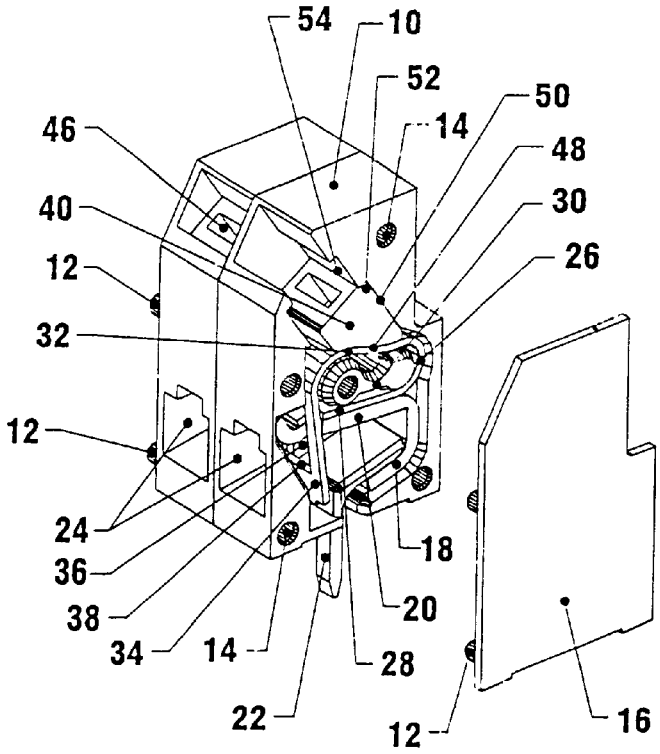
FIG. 2 shows a corresponding diagram of the connecting terminal in the open position.

To bring the connecting terminal into the open position, screwdriver 44 is used to engage with actuating element 40; actuating element 40 is thus pushed inward by axial pressure exerted on screwdriver 44. Wedge surface 50 of actuating element 40 then slides along inside wall 54 of housing 10, and pressure surface 48 of the actuating element presses elastic sidepiece 32 downward against its elastic force, so that clamping edge 38 is moved away from contact bridge 20. In the open position shown in FIG. 2, actuating element 40 has been pressed in so far that its locking edge 52 has arrived in latching recess 56. The force of elastic sidepiece 32 presses actuating element 40 against inside wall 54, so that latching edge 52 of actuating element 40 snaps into latching recess 56 and is held in this latching recess 56. The connecting terminal is thus held reliably in the open position shown in FIG. 2.

To connect a conductor to the connecting terminal, the insulation is first removed from the conductor, then the conductor is inserted through insertion opening 24 into opening 36. Once the stripped end of the conductor has arrived between clamping edge 38 and contact bridge 20, screwdriver 44 is fitted into recess 46 in the wide end of actuating element 40 and is used to pivot actuating element 40 downward against the force of elastic sidepiece 32, so that latching edge 52 is lifted out of latching recess 56. Elastic side- piece 32 now pushes actuating element 40 back into the clamping position; that is, elastic sidepiece 32 presses against pressure surface 48 of actuating element 40, with the result that wedge surface 50 of actuating element 40, this surface being at an angle to the pressure surface 48 to form the wedge, slides along inside wall 54. Thus elastic sidepiece 32 is given room to move far enough so that clamping edge 38 is able to clamp the inserted conductor against contact bridge 20.

Even though a particular embodiment of the invention has been illustrated and described herein, it is not intended to limit the invention and changes and modifications may be made therein within the scope of the following claims.

What is claimed is:

1. A connecting terminal assembly for printed circuit boards comprised of individual single pole clamping modules, each module comprising:

an insulating molded plastic housing (10) formed with a holding space that is sealed off on one side of the housing by a side cover wherein said side cover has pins (12) thereon that engage corresponding holes (14) on the one side of said housing to form said clamping module wherein said module has an access opening (42) at an upper end and step-shaped upper and lower latching recesses (56) in said access opening;

said holding space containing a "U" shaped connection contact (18), a clamping spring (26), and an actuating element (40) wherein one side-piece (28) of said connection contact forms a contact bridge (20) and another free elastic side-piece (32) forms a soldering pin (22) extending below said housing;

said actuating element (40) formed with a locking edge (52) positioned within said access opening (42) and operable between an upper position engaging said locking edge (52) with said upper latching recess (56) and a lower position engaging said locking edge (52) with said lower latching recess (56);

said clamping spring (26) resting on said contact bridge (20) and biased to maintain said actuating element (40) in said upper position and wherein said clamping spring (26) having a clamping end (34) and an opening (36) for insertion and holding a wire conductor;

said actuating element (40) being pushed into said lower position wherein said locking edge (52) engages said lower latching recess (56) and holding said clamping end (34) downwardly toward said soldering pin (22) so that to form an open position for inserting said wire conductor therein; and said actuating element (40) being tilted thereby releasing said locking edge (52) from said lower latching recess (56) to said upper latching recess so that to clamp said wire conductor between said clamping end (34) and said contact bridge (20).

* * * * *